US005569525A

United States Patent [19]

Masuda et al.

[11] Patent Number: 5,569,525

[45] Date of Patent: Oct. 29, 1996

[54] ULTRA-BULKY FIBER AGGREGATE AND PRODUCTION METHOD THEREOF

[76] Inventors: Yugoro Masuda, 17-6-341, Bessho-Honmachi, Takatsuki-shi, Osaka 569; Makio Nagata, 2790-11, Oaza Mure, Bofu-shi, Yamaguchi 747, both of Japan

[21] Appl. No.: 256,321

[22] PCT Filed: Oct. 29, 1993

[86] PCT No.: PCT/JP93/01583

§ 371 Date: Jul. 1, 1994

§ 102(e) Date: Jul. 1, 1994

[87] PCT Pub. No.: WO94/10366

PCT Pub. Date: May 11, 1994

[30] Foreign Application Priority Data

Nov. 2, 1992 [JP] Japan ..... 4-321275

[51] Int. Cl.[6] ..... D04H 1/58

[52] U.S. Cl. ..... 428/219; 428/220; 428/288; 428/296; 156/182; 156/273.3; 156/308.2

[58] Field of Search ..... 428/296, 219, 428/220, 288; 156/182, 273.3, 308.2

[56] References Cited

U.S. PATENT DOCUMENTS

Re. 30,955 6/1982 Stanistreet ..... 156/308.2
5,141,805 8/1992 Nohara et al. ..... 428/296

FOREIGN PATENT DOCUMENTS 0168225 1/1986 European Pat. Off. .
0171806 2/1986 European Pat. Off. .
0371807 6/1990 European Pat. Off. .

*Primary Examiner*—Christopher Raimund
*Attorney, Agent, or Firm*—Morgan & Finnegan, L.L.P.

[57] ABSTRACT

This ultra-bulky fiber aggregate is obtained by blending (A) a polyester fiber and (B) a core-sheath type composite fiber wherein a low melting point component lower in melting point than the core is used for the sheath. The interlacing portions of three-dimensionally continuous fibers are fused by melting of the sheath portions of the core-sheath type composite fiber. The fiber aggregate has a thickness of at least 200 mm and a density of 0.02 to 0.1 g/cm$^3$, and varies in density within ±5% in all of the longitudinal and transverse directions and the direction of height. The fiber aggregate can be used as a shoulder pad and a cushion material when it is cut. The production method of this fiber aggregate comprises blending (A) a polyester fiber and (B) a core-sheath type composite fiber using a low melting point component lower in melting point than the core for the sheath to obtain a card web, temporarily fusing card webs by far infrared rays or a hot air heater to laminate webs as required by a predetermined density and a predetermined thickness, and heat-treating the resulting laminate so as to mutually fuse the layers forming the laminate, wherein the heat-treatment is carried out by placing the laminate into a steam oven while it is compressed and clamped between two upper and lower plates and introducing the steam, the laminate being subjected to the heat-treatment while kept erect.

17 Claims, 2 Drawing Sheets

ULTRA-BULKY FIBER AGGREGATE AND PRODUCTION METHOD THEREOF

TECHNICAL FIELD

The present invention relates to a method for preparing an ultra-bulky fiber aggregate consisting of polyester fiber aggregate which contains a binder fiber having a low melting point.

BACKGROUND OF THE INVENTION

Various cushion materials made of polyester fiber have been developed. However, no product showing no strain by compression load and having voluminous feel has been prepared.

We have investigated and developed a method for the preparation of a cushion material, which can be used as a bed mat and the like and has a voluminous feel and a high quality, by using a conjugate fiber consisting of polyester (Japanese Laid-Open Patent Publication No. 152050 of 1990).

The method consists of a procedure in which polyester fibers (A) are mixed with core-sheath type composite or conjugate fibers (B) in which a sheath component of a lower melting point than that of the core component is used in a specified ratio and the resultant card web is temporarily melt-adhered with far-infrared ray or with a hot air circulating heater and the temporarily adhered webs are laminated according to the desired density and thickness and then the laminated webs are heated to melt-adhere each layer forming the laminate mutually. The method could prepare a cushion material of approximately 10 cm thick.

However, in the case that the webs are horizontally laminated and continuously heated in dry air, an increased thickness restricts the uniformity of the density and heat transmission. Also, in the case of a batch steaming system, an excessive thickness gives a vertical density gradient by the weight of the fibers themselves and results in an uneven product. Therefore, even the method described in Japanese Laid-Open Patent Publication No. 154050 of 1990 could not prepare stably a cushion material of as high a thickness as 20 cm or 50 cm in a uniform density.

Thus, the object of the present invention is to eliminate the disadvantages of the conventional technologies as mentioned above and to provide a product by using polyester fibers, which is an ultra-bulky block fiber aggregate having a high thickness of at least 20 cm, preferably 100 cm, and a uniform density in all of three directions like a urethane foam and can be used as a cushion material and a shoulder pad when sliced, and also to provide a method for the stable preparation thereof.

SUMMARY OF THE INVENTION

The present invention can provide an ultra-bulky block fiber aggregate, which can be sliced in the same manner as in urethane foam, by devising the material for the fiber aggregate and the heating method.

The product according to the present invention is prepared by blending (A) polyester fibers and (B) core-sheath type composite fibers in which a material having a lower melting point than that of the core component is used as the sheath component. It is characterized in that cubically continued intertwined parts of the fibers are melt-adhered by the fusion of the sheath part of said core-sheath type composite fibers and it has a thickness of at least 200 mm and a density of 0.02 to 0.1 g/cm$^3$ and the scattering of the density of not wider than ±5% in all of the three directions.

The product is prepared by a method in which (A) polyester fibers are blended with (B) core-sheath type composite fibers in which a material having a lower melting point than that of the core component is used as the sheath component and the resultant card web is temporarily melt-adhered with far-infrared ray or with a hot air circulating heater and the temporarily adhered webs are laminated according to the desired density and thickness and then the laminated webs are heated to melt-adhere each layer forming the laminate mutually. The heat treatment is carried out by compressing the laminate between two upper and lower plates, feeding it in a steam oven and introducing steam into the oven. The laminate is heated under a standing condition.

BRIEF DESCRIPTION OF THE DRAWINGS

Detailed Description of the Invention

Figure 1A:
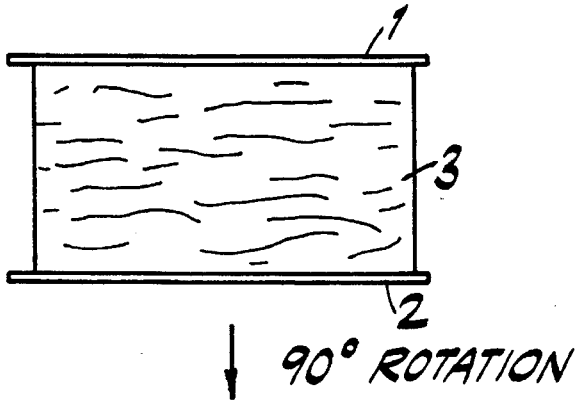

The present invention provides a fiber aggregate by a procedure in which webs open by a card are piled to a specified basis weight, for example, by cross layer method to prepare a nonwoven fabric in which the fibers are arranged transversely and the nonwoven fabric is layered and united to give a fiber aggregate. The laminate is compressed between two upper and lower plates to the desired density and thickness and then turned to press the fiber aggregate by its own weight to a different direction from that during lamination of the webs, such as turned by 90° so that the width direction (direction of fiber orientation) becomes vertical or turned by 90° transversely so that the standing direction becomes parallel to the fiber orientation, and then heat-set. The downward movement of the fibers by its own weight is prevented by the horizontal repulsive power of the fiber to give an ultra-bulky fiber aggregate having a uniform density to both directions of X and Y axis regardless of the thickness.

Such a method can prepare a fiber aggregate of an optional density regardless of the thickness of the fiber aggregate by always applying the horizontal repulsive power. For example, a low density product can be prepared by increasing the web thickness (by lowering the density), while a high density product can be prepared by decreasing the thickness (by increasing the density) even in a same basis weight.

In the present invention, the fiber aggregate can be heated while being rotated so that its own weight does not deviate to a direction.

As the polyester fiber (A) in the present invention, there can be used the usual polyethylene terephthalate, polyhexamethylene terephthalate, polytetramethylene terephthalate, poly-1,4-dimethylcyclohexane terephthalate, polyhydrolactone or a copolymerized ester thereof or a composite fiber prepared by conjugate spinning can be used. A side-by-side type composite fiber consisting of two polymers of different heat shrinkage rate is preferred as it expresses a spiral crimp to form a cubic structure. Particularly, a hollow yarn of a percentage of hollowness of 5 to 30% is preferred. It is preferred to use a fiber of a fineness of 4 to 30 denier and a cut length of 25 to 150 mm.

Further, as the core-sheath type composite fiber (B), there can be used a composite fiber prepared by using a usual polyester fiber as the core and a low melting polyester, polyolefin or polyamide as the sheath so that the difference between the melting points of the core component and the sheath component is at least 30° C. It is preferred to use a fiber having a fineness of 2 to 20 denier and a cut length of 25 to 76 mm.

As the core-sheath type composite fiber (B), it is particularly preferred to use a low melting polyester. Such polyesters are copolymerized esters which contain aliphatic dicarboxylic acids such as adipic acid and sebacic acid, aromatic dicarboxylic acids such as phthalic acid, isophthalic acid and naphthalenedicarboxylic acid and/or alicyclic dicarboxylic acids such as hexahydroterephthalic acid and hexahydroisophthalic acid and aliphatic or aromatic diols such as diethylene glycol, polyethylene glycol, propylene glycol and paraxylene glycol in specified numbers and also contain if required oxy acids such as parahydroxybenzoic acid. For example, it can be exemplified by a polyester prepared by adding isophthalic acid and 1,6-hexanediol to terephthalic acid and ethylene glycol and copolymerizing them.

According to the present invention, the surface of card webs of a low basis weight prepared by mixing the fibers of (A) and (B) in a weight ratio of 95–20:5–60 is temporarily melt-adhered by heating with far-infrared ray or with a hot air circulating heater, and the temporarily adhered webs are laminated according to the desired density and thickness, and then the laminate is compressed between two plates such as metal plates of high heat conductivity and the sandwiched laminate is stood up so that the thickness direction of the layers of the laminated webs is vertical and heated in a steam vessel. The temporary adhesion and heating are preferably carried out at a temperature which can melt the sheath component of the fiber (B) but cannot melt each of the fiber (A) and the core component of the fiber (B).

The heating is preferably carried out by evacuating the steam vessel to a pressure of 750 mmHg or less and then introducing steam of at least 1 kg/cm$^2$ to said steam vessel. The plates compressing the laminate comprise preferably perforated plates.

As the laminate is heated under compressed vertical condition so that the load does not affect the thickness direction of the laminate, a fiber aggregate of as high a thickness as 50 cm or 100 cm can be melt-adhered uniformly to the inner layer to prepare efficiently a product excellent in feel and appearance. A product can be easily prepared with a desired density, the scattering range of which is within ±5%. Also, a fiber aggregate having a hardness of not lower than 10 g/cm$^2$ can be prepared stably.

In the present invention, other fibers may be blended as the third component. Further, at least part of the fibers used in the present invention may be replaced by latent-crimping polyester composite fibers, antibacterial polyester fibers containing an antibacterial agent such as antibacterial zeolite or flame-retarding polyester fibers.

It is preferred that a hollow composite fiber is used as the main fiber (A) constituting the fiber aggregate according to the present invention. It is because the fiber directions of the webs intertwine irregularly and melt-adhered at the interlocked sites with the low melting component of the core-sheath type composite fiber to form a cubic structure that a product of very low strain caused by repeated compression load can be prepared.

BRIEF DESCRIPTION OF THE DRAWINGS

Figure 1B:
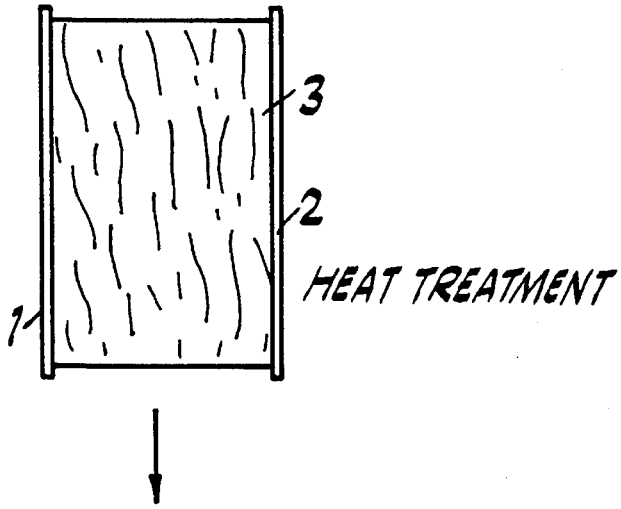
Figure 1C:
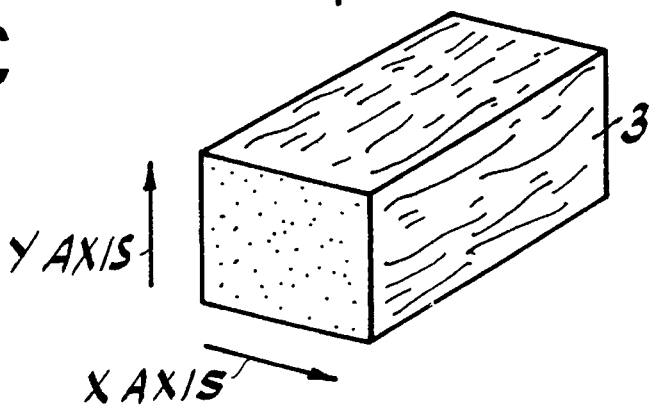

FIGS. 1A, 1B and 1C show the conditions of a fiber laminate before, during and after a heat treatment respectively in an example of the present invention.

Figure 2:
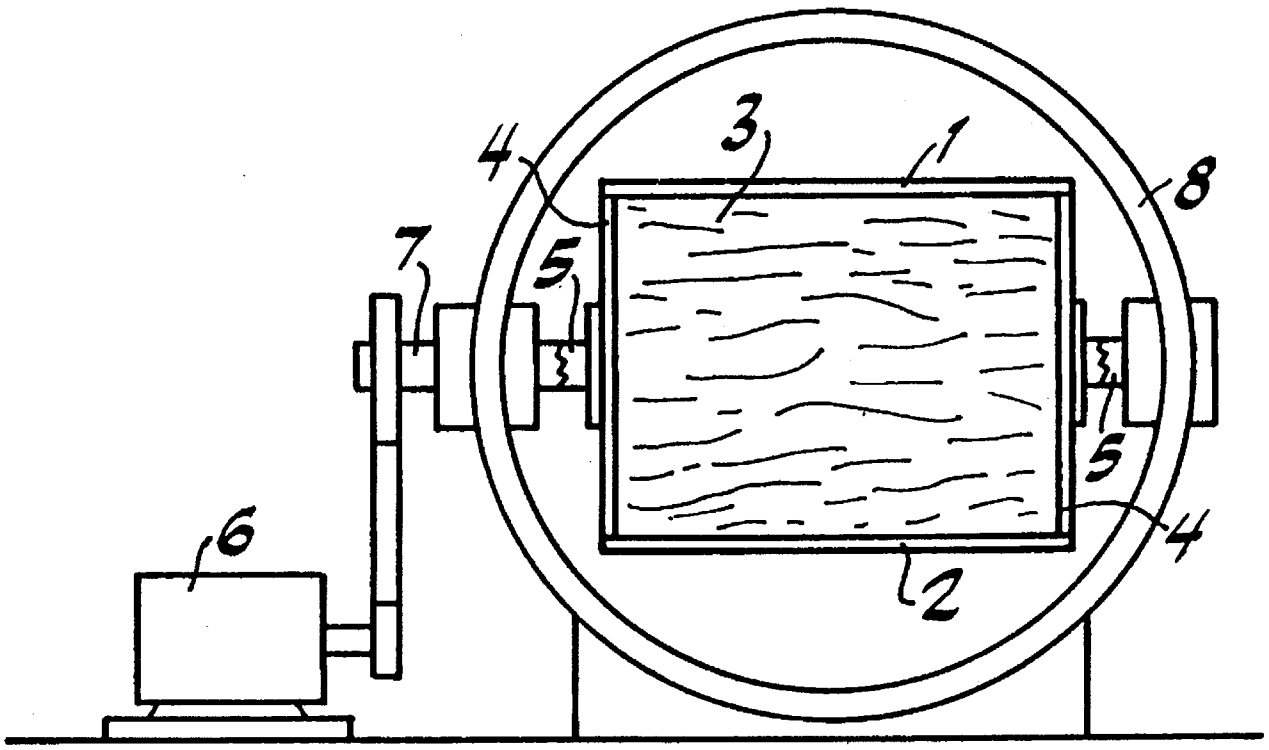

FIG. 2 shows an outlined drawing of a rotary setter used in an example of the present invention.

EXAMPLES 1 TO 6

(A) 80 weight % of hollow conjugated polyester fibers having a hollowness of 16.1% (fineness: 13 denier, cut length: 51 mm) prepared by conjugating side-by-side a polyethylene terephthalate having a relative viscosity of 1.37 with a polyethylene terephthalate having a relative viscosity of 1.22 in a ratio of 1:1 and (B) 20 weight of core-sheath type composite fibers (fineness: 4 denier, cut length: 51 mm) containing a polyethylene terephthalate having a melting point of 257° C. as the core and a copolymerized polyester (terephthalic acid/isophthalic acid=60/20) having a melting point of 110° C. as the sheath were mixed together in a hopper feeder and carded and then made into a web having a weight of 350 g/cm$^2$ with a cross layer method. The web was passed through a far-infrared heater at 130° C. continuously to give a melt-adhered web.

A number of the resultant webs of 1.5 m wide and 2 m long was piled between two plates 1 and 2 and compressed sandwich-like to a thickness of the laminate of 50 cm or 1 m and the piled webs (fiber aggregate 3) (Refer to FIG. 1-A) were turned by 90° longitudinally so that the width direction becomes to be vertical (Refer to FIG. 1-B) and then fed in a steam oven at the position. Air in the steam oven (and in the web laminate in it) was evacuated with a vacuum pump to a pressure of 750 mmHg and then steam of 3 kg/cm$^2$ was fed to the steam oven and the laminate was heated at 132° C. for 10 minutes.

Steam in the oven was evacuated again with a vacuum pump to give a block fiber aggregate 150 cm wide, 200 cm long and 50 cm thick having a density of respectively 0.025, 0.035 and 0.05 g/cm$^3$ in which the webs were melt-adhered into a whole mass in the oven (Refer to Table 1).

The resultant block fiber aggregate was restored to the original condition as shown in FIG. 1-C and sliced into 10 equal parts respectively to the horizontal direction (X axis) and the vertical direction (Y axis). Distributions of density and hardness, repeated compression and compression set of each portion were measured in accordance with JIS K6767 and K6401. The results are shown in Tables 1 and 2.

EXAMPLE 7

Webs piled between two plates 1 and 2 (fiber aggregate 3) were turned by 90° transversely so that the standing direction was parallel to the fiber orientation in the same manner as in Example 4 and then heated in the same manner as in Example 2.

The results of physical properties of the resultant block fiber aggregates are shown in Table 1.

COMPARATIVE EXAMPLES 1 TO 3

Webs were piled to 30 cm to 50 cm thick so that the piled web density was respectively 0.025, 0.035 and 0.055 g/cm$^3$ in the same manner as in Example 1 and the piled webs were heated under a condition that the width direction was horizontal as shown in FIG. 1A under the same condition as in Example 1.

The resultant block fiber aggregates were sliced into 10 equal parts to the X and Y axis directions and the distributions of density and hardness were measured. The results are shown in Tables 1 and 2.

TABLE 1

| Sample | Block thickness (cm) | Slice direction | Measured average density ($g/cm^3$) | Density gradient ($g/cm^3$) Upper limit | Density gradient ($g/cm^3$) Lower limit | Density scattering (%) Upper limit | Density scattering (%) Lower limit | Hardness of the fiber oriented surface Average | Hardness Upper limit | Hardness Lower limit |
|---|---|---|---|---|---|---|---|---|---|---|
| Example | | | | | | | | | | |
| 1 | 50 | X axis | 0.0273 | 0.0280 | 0.0268 | +2.6 | −1.8 | 33 | 34 | 31 |
| | | Y axis | 0.0270 | 0.0280 | 0.0263 | +4.5 | −1.9 | — | — | — |
| 2 | 100 | X axis | 0.0275 | 0.0281 | 0.0269 | +2.2 | −2.2 | 34 | 35 | 34 |
| | | Y axis | 0.0275 | 0.0281 | 0.0265 | +2.2 | −3.6 | — | — | — |
| 3 | 50 | X axis | 0.0369 | 0.0373 | 0.0363 | +1.1 | −1.6 | 48 | 48 | 47 |
| | | Y axis | 0.0370 | 0.0375 | 0.0363 | +4.1 | −1.9 | — | — | — |
| 4 | 100 | X axis | 0.0370 | 0.0378 | 0.0364 | +2.2 | −1.6 | 50 | 51 | 49 |
| | | Y axis | 0.0371 | 0.0376 | 0.0360 | +1.3 | −3.0 | — | — | — |
| 5 | 50 | X axis | 0.0495 | 0.0508 | 0.0491 | +2.6 | −0.8 | 64 | 65 | 63 |
| | | Y axis | 0.0505 | 0.0515 | 0.0480 | +2.2 | −4.9 | — | — | — |
| 6 | 100 | X axis | 0.0501 | 0.0510 | 0.0493 | +1.8 | −1.6 | 65 | 66 | 63 |
| | | Y axis | 0.0508 | 0.0515 | 0.0496 | +1.4 | −2.4 | — | — | — |
| 7 | 100 | X axis | 0.0367 | 0.0379 | 0.0361 | +3.3 | −1.6 | — | — | — |
| | | Y axis | 0.0360 | 0.0374 | 0.0353 | +3.7 | −1.9 | — | — | — |
| Comparative Example | | | | | | | | | | |
| 1 | 30 | X axis | 0.0263 | 0.0289 | 0.0240 | +9.9 | −8.7 | 30 | 36 | 25 |
| 2 | 40 | X axis | 0.0359 | 0.0393 | 0.0331 | +9.4 | −7.8 | 46 | 57 | 38 |
| 3 | 50 | X axis | 0.0510 | 0.0580 | 0.0424 | +13.7 | −16.9 | 62 | 79 | 43 |

Note) The "density scattering" shows the range of density scattering based on the average density.

TABLE 2

| Sample | Block thickness (cm) | Slice direction | Density ($g/cm^3$) | Compression hardness ($kgf/cm^2$) | Compression set (%) | Repeated compression set (%) |
|---|---|---|---|---|---|---|
| Example | | | | | | |
| 2 | 100 | X axis | 0.0281 | $4.3 \times 10^{-2}$ | 6.7 | 6.3 |
| | | | 0.0269 | $4.2 \times 10^{-2}$ | 6.6 | 5.8 |
| 4 | 100 | X axis | 0.0378 | $9.5 \times 10^{-2}$ | 8.3 | 7.5 |
| | | | 0.0364 | $9.3 \times 10^{-2}$ | 8.1 | 6.8 |
| 6 | 100 | X axis | 0.0510 | $21.2 \times 10^{-2}$ | 10.2 | 8.8 |
| | | | 0.0493 | $20.4 \times 10^{-2}$ | 9.7 | 8.5 |
| Comparative Example | | | | | | |
| 3 | 50 | X axis | 0.0580 | $27.6 \times 10^{-2}$ | 12.9 | 13.4 |
| | | | 0.0424 | $15.7 \times 10^{-2}$ | 9.8 | 10.2 |

TEST METHOD

1. Surface hardness (hardness of fiber-oriented surface)

Nine positions of each surfaces sliced to the X axis direction were measured by using an Asker F type hardness meter. Their average is shown.

2. Average Density

The volume and the weight of each sample sliced to X axis and Y axis direction were measured and their average values were calculated.

3. Density Difference

From the average density of each sample sliced into 10 layers to X axis and Y axis direction, the quality was judged by a criterion that the fluctuation of the densities between the upper and lower limits was within ±5%.

4. Compression Hardness (in accordance with JIS K6401)

A sample of 150×150 mm size was placed between two parallel upper and lower compression plates and compressed at a rate of 10 mm/sec or less to 0.36 kgf and then the thickness was measured at that time as the initial thickness. Then it was compressed to 25% of the initial thickness and stood for 20 seconds and the load was read to give the hardness value.

5. Compression Set

A sample of 150×150 mm size was placed between two parallel upper and lower compression plates and compressed to 50% of the initial thickness and stood at room temperature for 40 hours and then the compression plates were removed and the sample was stood for 30 minutes and the thickness was measured.

Compression set (%)$=(t_0-t_1)\times 100/t_0$ $t_0$: Initial sample thickness (mm)

$t_1$: Sample thickness after tested (mmZ).

6. Repeated Compression Set

A sample of 150×150 mm size was placed between two parallel upper and lower compression plates and compressed repeatedly for continuous 80,000 times to 50% of the sample thickness at a rate of 60 times a minute at room temperature and then the sample was removed and stood for 30 minutes and the thickness was measured and the compression set was calculated by the same equation as above.

From the measurements of Tables 1 and 2, it can be found that the ultra-bulky fiber aggregates of each density prepared according to the present invention were focused in a very narrow range of density gradient at any part of X or Y direction and had a definite hardness depending on their densities and thus they were uniform fiber aggregates of excellent quality regardless of their thicknesses and densities.

Therefore, it can be found that they are fiber aggregates of low strain and of excellent elasticity in the compression characteristics.

EXAMPLE 8

The method of Example 7 was carried out by using a rotary setter shown in FIG. 2. This equipment has a structure in which a fiber aggregate 3 placed between the plates 1 and 2 is held by a plate support 4 in a can 8 and equipped to a rotary shaft 7 rotated by a drive motor 6 through a joint 5. It can heat the aggregate 3 while rotated in the can 8.

This method can heat the fiber aggregate under a condition in which the direction of its weight scatters and hence a product of very low fluctuation in density can be prepared.

INDUSTRIAL APPLICABILITY OF THE INVENTION

As a thick block fiber aggregate can be obtained in the present invention, it can be sliced to make a shoulder pad, a cushion material, an automobile seat and the like. Further, as the fiber aggregate can be molded by heat and other means, it can be also used as a molding material. Such molding methods improve productivity and reduce manufacturing cost.

Furthermore, the inventive method has an advantage of reducing the treating period as it is higher in heat efficiency than the conventional multiple plate process.

What is claimed is:

1. An ultra-bulky block fiber aggregate comprising a blend of polyester fibers (A) and core-sheath type composite fibers (B) in which the sheath component of the core-sheath type composite fibers has a lower melting point than the core component, wherein the fibers are melt-adhered by the fusion of the sheath component of the core-sheath type composite fibers and the fiber aggregate has a thickness of at least about 200 mm and a density of from about 0.02 to about 0.1 g/cm$^3$ and the the density of the fiber aggregate varies by no more than about ±5% throughout the web.

2. An ultra-bulky block fiber aggregate according to claim 1, in which the polyester fibers (A) are side-by-side type composite fibers comprising two polymers having a different heat shrinkage rate.

3. An ultra-bulky fiber aggregate according to claim 1, in which the polyester fibers (A) are a hollow yarn having a percentage of hollowness of from about 5 to about 30%.

4. An ultra-bulky block fiber aggregate according to claim 1, in which the polyester fibers (A) have a fineness of from about 4 to about 30 denier and a cut length of from about 25 to about 150 mm.

5. An ultra-bulky block fiber aggregate according to claim 1, in which the difference between the melting points of the core component and the sheath component of the core-sheath type composite fibers (B) is at least about 30° C., the core component comprises a polyester fiber and the sheath component comprises a low-melting polyester, polyolefin or polyamide.

6. An ultra-bulky block fiber aggregate according to claim 1, in which the core-sheath type composite fibers (B) have a fineness of from about 2 to about 20 denier and a cut length of from about 25 to about 76 mm.

7. An ultra-bulky block fiber aggregate according to claim 1, in which the blend ratio of the polyester fibers (A) to the core-sheath type composite fibers (B) is from about 95–40 to about 5–60 by weight.

8. A method for the preparation of an ultra-bulky fiber aggregate, comprising the steps of:

preparing a carded web of blended polyester fibers (A) and core-sheath type composite fibers (B) in which the sheath component of the core-sheath type composite fibers has a lower melting point than the core component;

temporarily melt adhering the carded web by heating with far infrared radiation or with a hot air circulating heater;

laminating together a plurality of the temporarily adhered carded webs to achieve a fiber aggregate of the desired density and thickness and;

heating the laminate to heat-adhere each layer constituting the laminate;

wherein the step of heat adhering the laminate is carried out by compressing the laminate between upper and lower plates in the thickness direction of the laminate to form a laminate-plate assembly, placing the laminate-plate assembly into a steam vessel such that the thickness direction of the laminate is oriented perpendicular to the direction of the force of gravity, and heating the laminate-plate assembly by introducing steam into the vessel.

9. A method according to claim 8, in which the temporary melt-adhering and the heating steps are carried out at a temperature at which the sheath component of the core-sheath type composite fibers (B) is molten but each of the polyester fibers (A) and the core component of the core-sheath type composite fibers (B) is not molten.

10. A method according to claim 8, in which the polyester fibers (A) are side-by-side type composite fibers comprising two polymers having a different heat shrinkage rate.

11. A method according to claim 8, in which the polyester fibers (A) are a hollow yarn having a percentage of hollowness of from about 5 to about 30%.

12. A method according to claim 8, in which the polyester fibers (A) have a fineness of from about 4 to about 30 denier and a cut length of from about 25 to about 150 mm.

13. A method according to claim 8, in which the difference between the melting points of the core component and the sheath component of the core-sheath type composite fibers (B) is at least about 30° C., the core component comprises a usual polyester fiber and the sheath component comprises a low-melting polyester, polyolefin or polyamide.

14. A method according to claim 8, in which the core-sheath type composite fibers (B) have a fineness of from about 2 to about 20 denier and a cut length of from about 25 to about 76 mm.

15. A method according to claim 8, in which the blend ratio of the polyester fibers (A) to the core-sheath type composite fibers (B) is from about 95–40 to about 5–60 by weight.

16. A method for the preparation of an ultra-bulky fiber aggregate, comprising the steps of:

preparing a carded web of blended polyester fibers (A) and core-sheath type composite fibers (B) in which the sheath component of the core-sheath type composite fibers has a lower melting point than the core component;

temporarily melt adhering the carded web by heating with far infrared radiation or with a hot air circulating heater;

laminating together a plurality of the temporarily adhered carded webs to achieve a fiber aggregate of the desired density and thickness and;

heating the laminate to heat-adhere each layer constituting the laminate;

wherein the step of heat adhering the laminate is carried out by compressing the laminate between upper and lower plates in the thickness direction of the laminate to form a laminate-plate assembly, placing the laminate-plate assembly into a steam vessel and rotating while simultaneously heating the laminate-plate assembly by introducing steam into the vessel.

17. The method of claim 8 wherein the fibers in each layer of the laminate are oriented in the same direction and wherein the fiber direction is parallel to the direction of the force of gravity during the step of heat-adhering the laminate.

* * * * *

UNITED STATES PATENT AND TRADEMARK OFFICE

CERTIFICATE OF CORRECTION

PATENT NO. : 5,569,525
DATED : October 29, 1996
INVENTOR(S) : Yugoro Masuda, et. al.

It is certified that error appears in the above-indentified patent and that said Letters Patent is hereby corrected as shown below:

Title page, item [73], Assignee: should read--Kanebo, Ltd., Tokyo, Japan--.

Signed and Sealed this

Twenty-first Day of October 1997

*Attest:*

Bruce Lehman

BRUCE LEHMAN

*Attesting Officer*

*Commissioner of Patents and Trademarks*